US005572190A

United States Patent [19]

Ross et al.

[11] Patent Number: 5,572,190

[45] **Date of Patent: *Nov. 5, 1996**

[54] BATTERYLESS SENSOR USED IN SECURITY APPLICATIONS

[75] Inventors: Gerald F. Ross, Longboat Key, Fla.; Richard M. Mara, Shapleigh, Me.; Kenneth W. Robbins, North Reading, Mass.

[73] Assignee: Anro Engineering, Inc., Lexington, Mass.

[ * ] Notice: The term of this patent shall not extend beyond the expiration date of Pat. No. 5,317,303.

[21] Appl. No.: 408,642

[22] Filed: Mar. 22, 1995

[51] Int. Cl.[6] ..... G08B 13/00

[52] U.S. Cl. ..... 340/541; 340/530; 340/539; 340/545; 340/665; 340/693; 340/566; 343/700 MS; 343/720; 73/649

[58] Field of Search ..... 340/541, 530, 340/539, 562, 545, 665, 693, 566; 310/311, 318, 328, 358; 343/700 MS, 702, 720; 73/649

[56] References Cited

U.S. PATENT DOCUMENTS

| | | | |
|---|---|---|---|
| 2,996,713 | 8/1961 | Boyer | 343/700 MS |
| 3,614,760 | 10/1971 | Zimmet | 340/539 |
| 3,696,359 | 10/1972 | Ross et al. | 340/547 |
| 3,735,412 | 5/1973 | Kampmeyer | 340/825.72 |
| 3,772,669 | 11/1973 | Johnston et al. | 340/539 |
| 3,781,836 | 12/1973 | Kruper et al. | 340/539 |
| 3,818,467 | 6/1974 | Willis | 340/539 |
| 3,827,038 | 7/1974 | Willis | 340/539 |
| 3,831,157 | 8/1974 | Wiegand | 340/539 |
| 3,970,939 | 7/1976 | Willis | 340/333 |
| 4,538,139 | 8/1985 | Clemente | 340/539 |
| 4,821,040 | 4/1989 | Johnston et al. | 343/700 MS |
| 4,870,868 | 10/1989 | Gastgeb et al. | 73/649 |
| 5,216,838 | 6/1993 | DeLand et al. | 49/280 |
| 5,317,303 | 5/1994 | Ross et al. | 340/547 |
| 5,424,716 | 6/1995 | Park | 340/550 |

*Primary Examiner*—Jeffery Hofsass
*Assistant Examiner*—Benjamin C. Lee
*Attorney, Agent, or Firm*—George Grayson

[57] ABSTRACT

A batteryless sensor includes either a micro miniature generator/gear train or a piezoelectric crystal to convert a movement of a door or window to an ersatz $V_{cc}$ transient power supply to radiate a coded RF signal to a receiver, a distance away. The receiver may monitor a multiplicity of sensors to identify a source of an intrusion.

11 Claims, 7 Drawing Sheets

BATTERYLESS SENSOR USED IN SECURITY APPLICATIONS

REFERENCED PATENT

U.S. Pat. No. 5,317,303 entitled, "BATTERYLESS SENSOR USED IN SECURITY APPLICATIONS", inventors Ross, Mara, Robbins and Fontana.

DESCRIPTION OF THE PRIOR ART

1. Field of the Invention

This invention relates to a batteryless and unattended sensor which can be used in security system applications to, for example, determine remotely, the opening/closing of a door or window.

2. Description of the Prior Art

U.S. Pat. No. 5,317,303 entitled, "BATTERYLESS SENSOR USED IN SECURITY APPLICATIONS" discloses a concealed sensor unit which includes a permanent magnet motor which operates as a generator to convert rotational or translated energy to an ersatz Vcc transient power supply via a mechanical arrangement to radiate a coded VHF oscillator signal to a repeater or central processing unit located as far as one mile from the sensor. The receiver is able to monitor a multiplicity of sensor units.

Since many sensor units are required to protect a building, even a medium sized building, low cost, commercially available components were used for a cost competitive system. However these low cost components put certain size limitations on each sensor. Since the installation of each sensor is covert, smaller is better. Remember each sensor is installed in a door jamb, a window sill, or even embedded in concrete. The possibilities where the sensing of a physical movement of a part of a structure, a drawer opening, a cabinet door opening, an intruder stepping on an area of a floor, are endless. Therefore it is essential to have a sensor as compact as possible, be installed easily, even in confined areas and which should be maintenance free for years.

SUMMARY OF THE INVENTION

These advantages are achieved in a preferred embodiment of the present invention. A micro miniature generator/gear train along with its electronics is hidden in a door jamb or a window sill. A movement of a door or a window is amplified by the gear train which drives the generator to put out a peak voltage. The peak voltage is rectified and applied to a tone generator and VHF oscillator to radiate a coded RF signal. A receiver, as far as one mile away which is interrogating a multiplicity of sensors, can identify the source of an intrusion. The micro miniature generator/gear train may be placed in a door knob to sense the rotational movement caused by an intruder opening the door with a key. The coded RF signal, generated by its electronics hidden in a drilled out opening in the door, is coupled to the door knob which acts as an antenna to radiate the coded RF signal.

A piezoelectric crystal may also be placed on a door jamb on the hinge side or between the arms of one of the hinges to sense the opening or closing of the door. The voltage generated by the crystal being distorted is also converted to the coded RF signal as described above.

In the event of a metal door, a patch antenna insulated from the metal door by a dielectric will radiate the coded RF signal to be picked by the receiver.

DESCRIPTION OF THE PREFERRED EMBODIMENT

Figure 1:
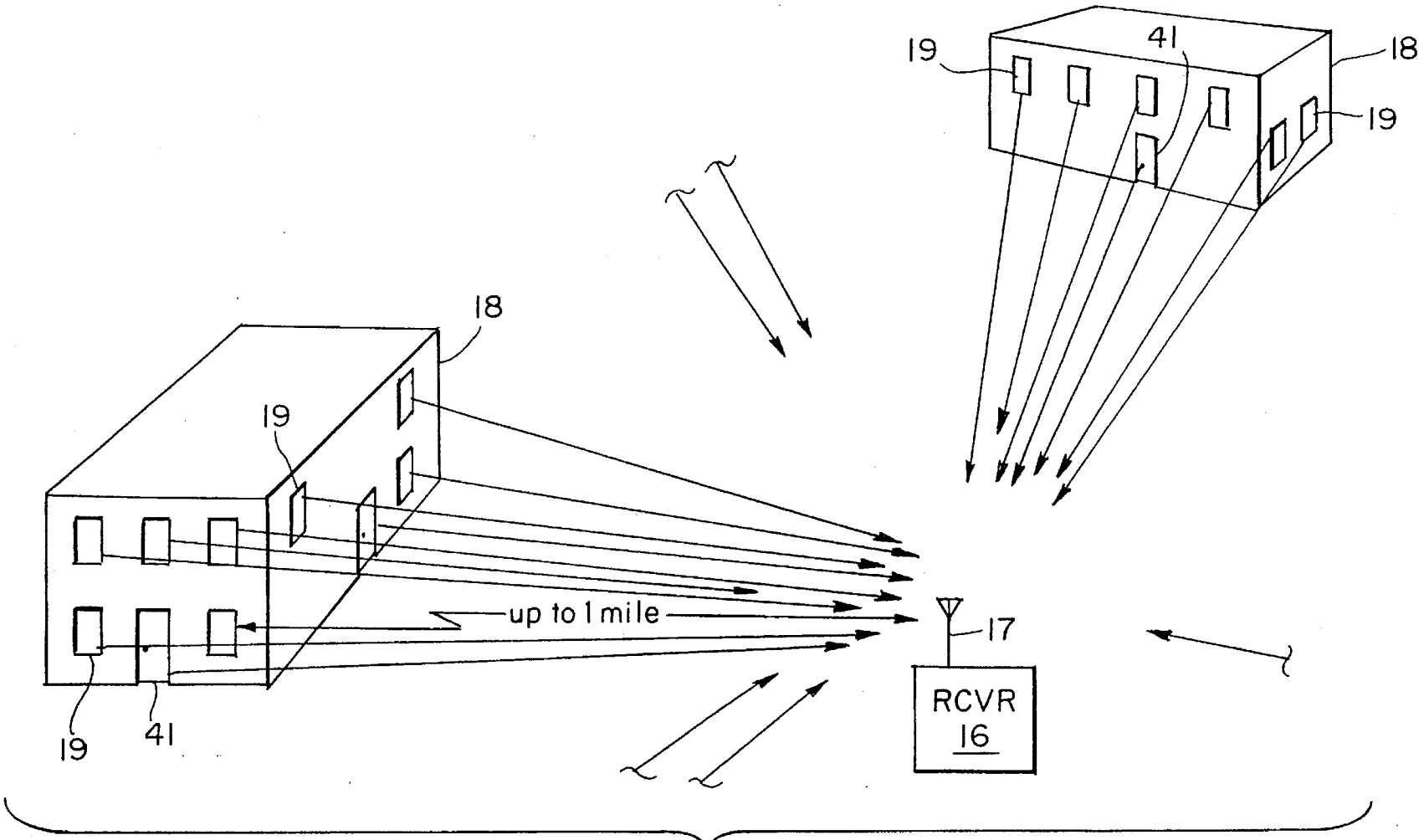
FIG. 1 shows an array of coded sensors and a central receiver.

FIG. 1 shows the environment of the invention. Sensors installed in door jambs of doors 41 and window sills of windows 19 of buildings 18 transmit coded RF signals if any door 41 or window 19 is disturbed. The coded RF signals which identify the disturbance location are received by a receiver 16 via an antenna 17. The receiver 16 may be as far as one mile from the source of the disturbance. U.S. Pat. No. 5,317,303 is incorporated by reference.

Rack & Pinion

Figure 2B:
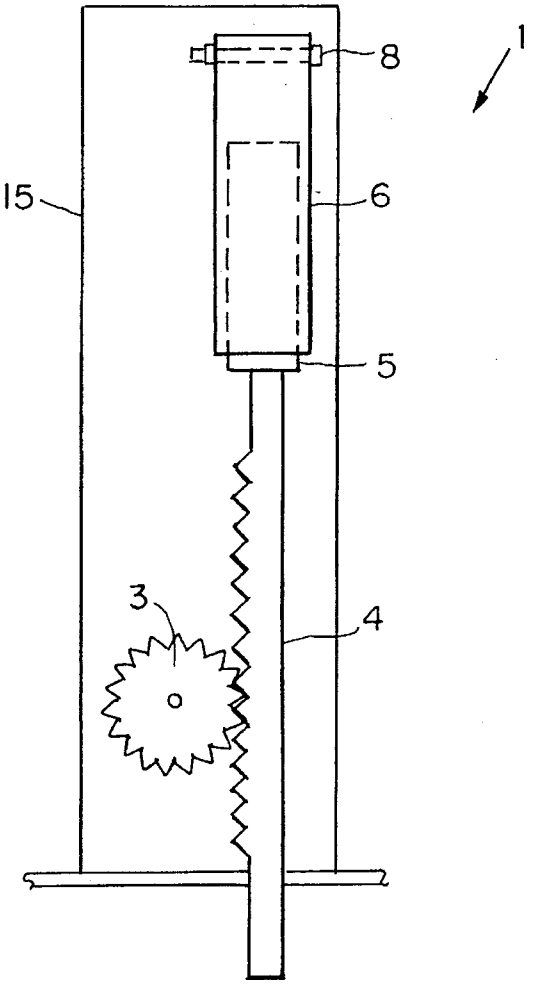
FIG. 2 shows details of a batteryless sensor using a rack and pinion to drive a micro miniature generator/gear train.
Figure 2A:
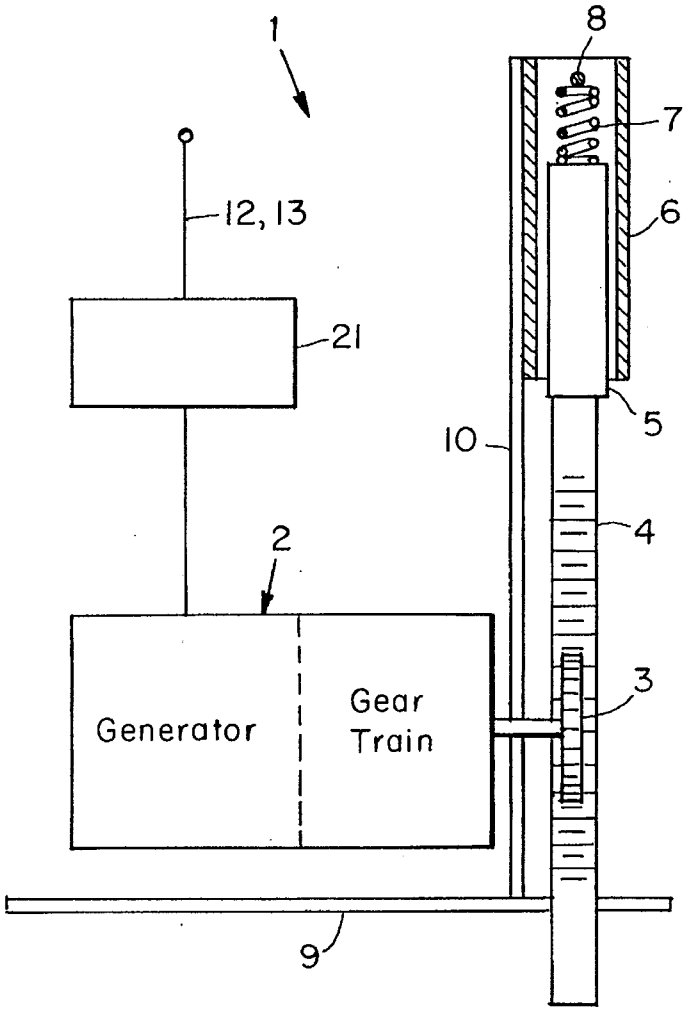

FIG. 2 shows an assembly of a batteryless sensor 1, which incudes a micro miniature generator/gear train 2, typically a 9/16 inch spur gear 3 which drives a 14 tooth/inch rack 4.

The rack 4 is fastened on one end to a brass cylinder 5. The brass cylinder 5 telescopes into a second somewhat larger cylinder 6 which is fixed to support plate 10. Inside the cylinder 6 is a compression spring 7 held in place by a pin 8. The rack 4 extends about ⅜ of an inch beyond a mounting plate 9. The entire unit 1 including an electronic package 21 is installed in a box 15 which is covertly mounted in the jamb of a door or in a sill of a window.

When the door/window is closed, the rack 4 compresses the spring 7 by about ⅜ inch. When the door/window is opened, the spring force drives the rack 4 turning the spur gear 3, and in turn the gear train, and permanent magnet generator 2 producing sufficient energy to radiate a 1–10 milliwatt signal over a 150 millisecond duration. When the door closes the action reverses; the rack 4 is driven down and generator 2 spins in the opposite direction.

The entire sensor 1, except for a small protruding portion of the rack 4, fits within the jamb of a door or sill of the window. The overall size of the package is typically 2½ in. by 1⅛ in. by 2 in. (deep). In the preferred embodiment, the gear train and permanent magnet generator 2 is manufactured both in Germany and Switzerland by the Faulhaler Group; the U.S. distributor is Micro Mo Electronics, St. Petersburg, Fla. We use Model #1516E~06516A, which includes a 262:1 gear train reduction. It is sold as a 12 volt permanent magnet motor. The size of the improved unit, including the gear train, is 0.63 inches in diameter by 1.24 inches long (excluding a 0.4 inch long shaft).

Figure 8:
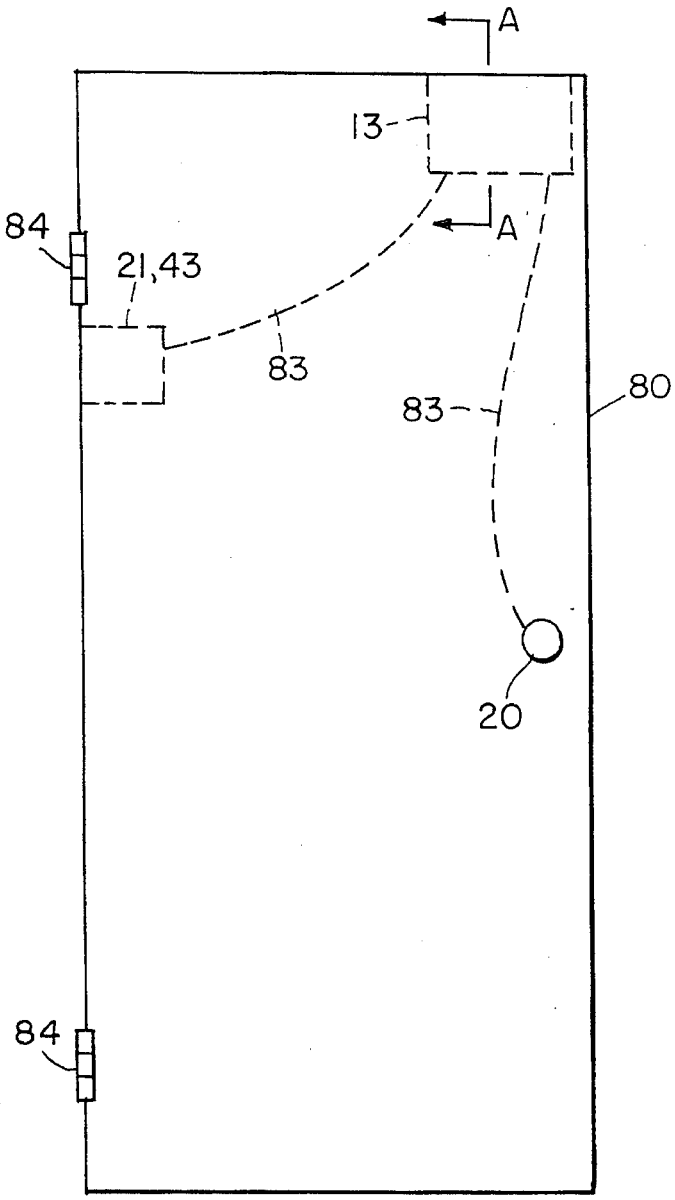
FIG. 8 shows a patch antenna for transmitting coded signals when a metal door is disturbed.

A type of antenna depends upon whether or not a wood or metal door is employed and the operating frequency of the oscillator. We have successfully used a dipole 12 with the transmitter used in the referenced patent by employing the door itself as a form of antenna. For the metal door a so-called patch antenna 13 as shown in FIG. 8 is employed. The higher the operating frequency, the smaller the antenna size required for efficient radiation. We are now operating at about 50 MHz because of the availability of low-cost components used currently in portable phones, and hope for future models to extend the operating frequency to 900 MHz.

Covert Mounting of Generator/Gear Train Within Key/Lockset Door Knob

Figure 3:
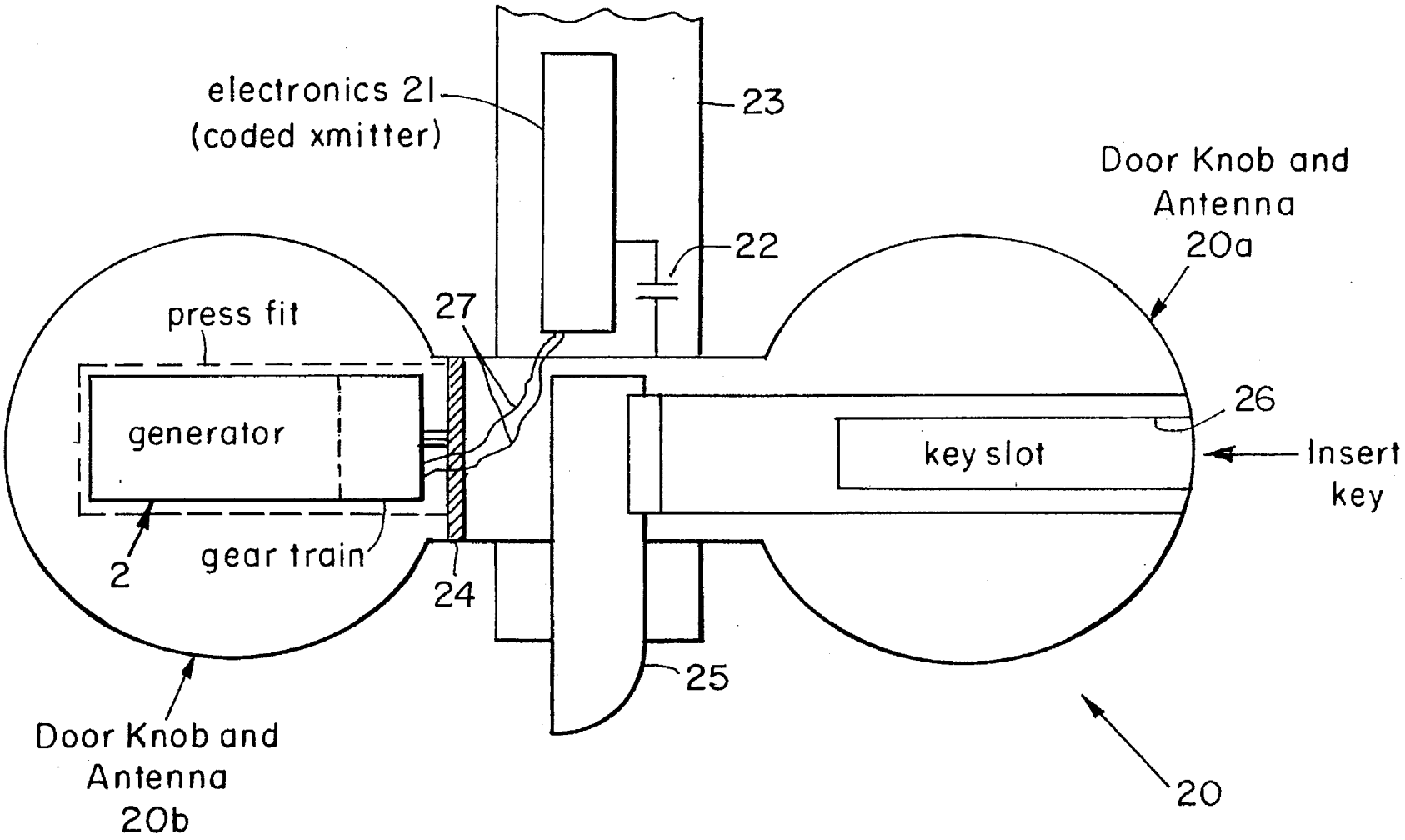
FIG. 3 shows the details of the micro miniature generator/gear train mounted in a commercially available lockset door knob.

In a large number of commercially available door knobs 20 which includes a keyslot 26, the Faulhaler micro miniature generator/gear train 2 of FIG. 2 can be placed directly in the door knob 20, as shown in FIG. 3.

Here, the door knob 20 also serves as an antenna. A capacitor 22 couples the door knob 20 to a transmitter output tank circuit 21. In a typical lockset 20, there are two threaded screws (not shown) which hold both parts, 20*a* and 20*b*, of the lockset 20 together when they are placed on both sides of a door 23. We press fit the case of the generator/gear train 2 in contact with the knob subassembly so that as the knob turns, the case of the generator/gear train also turns. A brass bar 24 supported in place by the two screws holding both parts 20*a* and 20*b* of the door knob 20 together is physically connected to the shaft of the PM generator/gear train 2 preventing it from rotating. In this manner, as the handle turns, the generator/gear train 2 casing turns, but the armature is locked. The result is that an EMF is generated, as in the normal mode of operation, because of the relative motion between the armature and the permanent magnet (PM) field pieces. The voltage is applied to electronics 21 through power wires 27.

Figure 4:
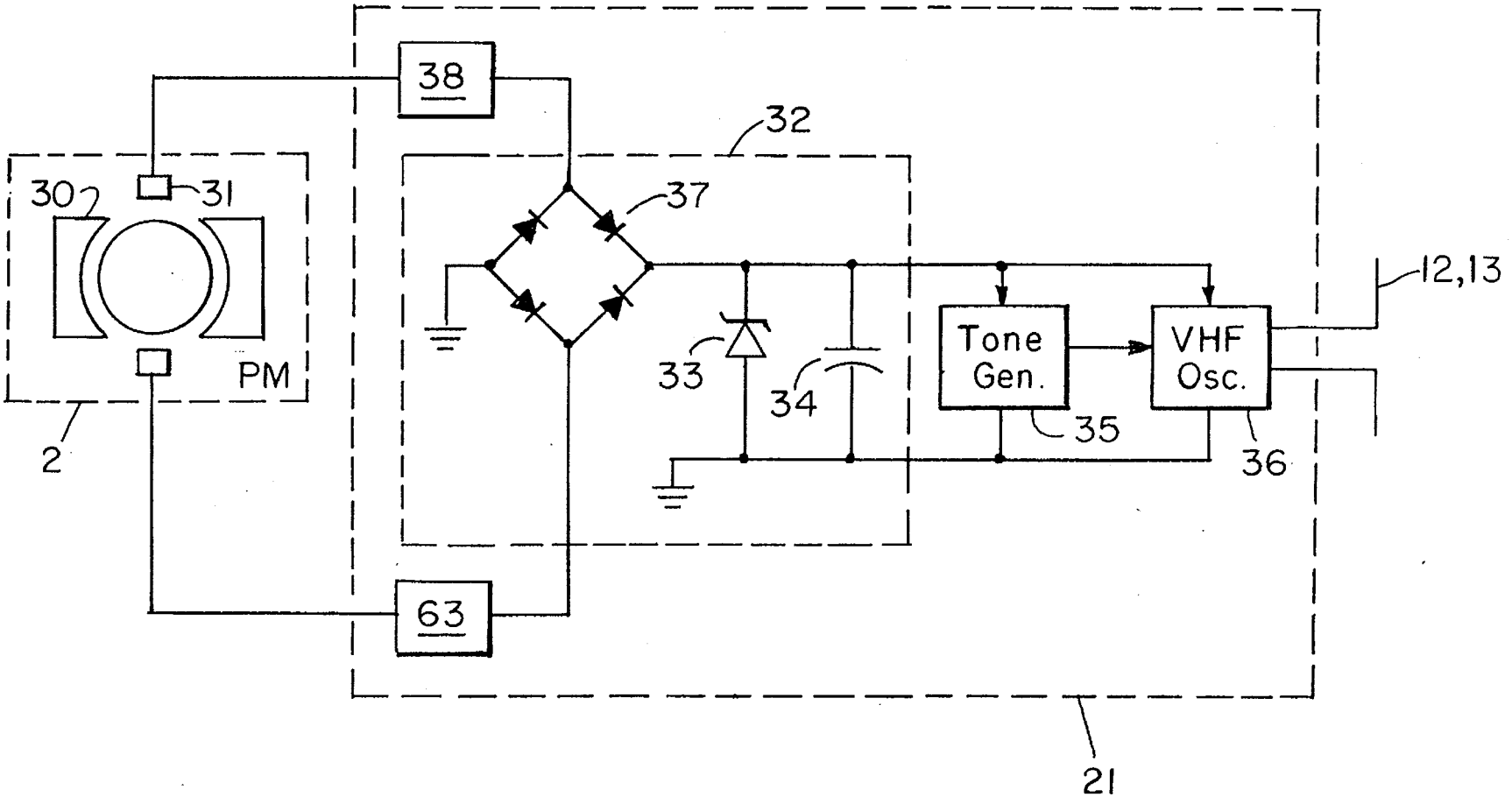
FIG. 4 shows an electronic circuit for transmitting coded signals from rack and pinion sensor and the door knob sensor.

As shown in FIG. 4, the resulting outputs from generator brushes 31, permanent magnet (PM) field 30 from the armature of the generator 2, applied to the transmitter 21, are filtered by running them through two sets of six ferrite beads 38 and 63 each which serves as RF chokes. This prevents 50 MHz energy from feeding back into the transmitter/oscillator and tone coding circuitry 21. This is necessary because the output of the transmitter tank circuit is coupled through the 33 pf capacitor 22 to the door knob 20 itself, which also serves as the antenna. At 50 MHz, this represents about 100 ohm reactance. Note that this is not the most efficient coupling scheme; the coupling must be loose enough to permit oscillation, while tight enough to provide for maximum effective radiated power (erp).

It is desirable to obtain the oscillator operating voltage $V_{cc}$ (i.e., the ersatz power supply) with as slow a turning of the knob as possible. We have found by experiment that we could eliminate the 78L05 regulator and the DF02M full-wave bridge rectifier indicated in the No. '303 patent by using lower voltage drop components described below.

The output signals from the beads 38 and 63 are applied to a full wave Schottky diode bridge rectifier 32 made up of diodes 37 (e.g., IN5817; 1A, 20 volts), a single Zener diode 33 (e.g., IN4735A; 6.2 volts, 1 watt) and a 100 microfarad filter capacitor 34. These are low cost items; for example the Schottky diodes cost about 40 cents each, while the Zener is 25 cents each in small quantities. The full wave bridge rectifier 32 converts the rotation of knob 20, either CW or CCW, directly to the required +6 volts signal.

The rectifier output signal is applied to both a tone generator 35 (MX503 or 258TC) and a modulator and VHF oscillator 36 (MC 2833) which feeds the essentially resonant dipole 12 or a patch antenna 13. The electronics circuit 21 of FIG. 2 operates in a similar manner to that described in the reference patent.

The rack and pinion arrangement, as described in FIG. 2, or the covert door knob 20 installation produces sufficient energy to activate the oscillator and its tone generator 36. The resistance of the armature of the current generator unit 2 is about 120 ohms, which means the available power at 5 volts into a 1,000 ohm oscillator load is 25 milliwatts.

To measure the effectiveness of the door knob 20 itself as an antenna, we set up an experiment using a tuned dipole @ 50 MHz as a "baseline" antenna. It is difficult to measure effective range of the sensor because range depends on the quality of contact between the person and door knob as well as the size of the intruder. Even without holding the knob, (with the ersatz supply provided by a separate pulser), the range was about 100 feet @ 50 MHz. Here, the knob was placed on a wooden door. If the knob was insulated, but placed on a metal door frame which acted as a ground plane, the distance would likely be substantially increased. Also, the range should be improved by increasing the operating frequency toward 900 MHz.

The transmitter and the tone coding circuitry 21, is the same as suggested in the referenced patent. For future models we plan to send a train of four pulses; for example, each pulse having a duration of 25 milliseconds separated by a dead time of 25 milliseconds. The center frequency $f_o$, will be FM tone modulated as we presently do. The idea here is to significantly reduce the probability of a false alarm by requiring at the receiver that at least three out of four hits are received at a given tone before we declare that an intrusion has resulted.

Finally, a word about installation. The electronics package 21 shown in FIG. 4 is configured so that it can be placed in a cylindrical cavity which can be drilled from the edge of the door 23 through an opening already available to accommodate the bolt 25 or tongue of the lock. The present electronics package fits into a hole that is 4½" long and ⅞" diameter. The prototype models incorporating surface mount technology should be much smaller.

Piezoelectric Energy Source

To derive sufficient energy from a piezoelectric ceramic crystal to operate the batteryless door/window sensor, requires certain circuit novelty. A piezoelectric crystal is a form of capacitor where energy caused by distending the crystal results in a charge buildup on the surface of the material. The charge buildup is a function of the force/unit area on the crystal material as well as the rate of change of that force; the larger the rate of change, the more energy output. Also, the more volume of piezoelectric material, the more energy output can be expected. The cost of piezoelectric material increases rapidly with increasing material volume. For example, a slab of a piezoelectric ceramic block made by Ferroperm, Inc. and measuring 2 inches by 1 inch by 0.2 inches, cost $26 in small quantities.

The ceramic block was designed to fit in the jamb of the door or between the arms of a hinge. The force available from the opening/closing action of the door at the crystal is substantial and is determined by the large ratio of the distance from the knob to the hinge divided by about half of the length of the ceramic slab (e.g., about 70:1). In this manner, a one pound force applied to closing the door translates to about 70 pound force at the piezoelectric slab. We tried to simulate this large force in a controlled experiment by the use of a small anvil press using ½ inch phenolic and brass pressure plates to hold the PZT piezoelectric material. With about a 70 pound force applied by the press, the material generated a 50 volt peak signal of 10 ms duration into a 1 megohm load. A moderate hammer blow (e.g., an impulsive force) gave about the same output voltage, but the duration of the output was only 3 ms. By using a 100 megohm load instead, the output voltage approached 360 volts. By using a silicon-controlled rectifier load (MCR100-8), as much as 30 volts, with a duration of 100 ms, was obtained in conjunction with a LPF. The voltage exceeds 750 volts and breaks down a gas tube placed in series with the crystal and load producing between 5–12 volts at the output of a low-pass filter network.

The conclusion from the investigation is that a virtual open circuit, threshold device, in conjunction with low pass (LPF) post filtering, is required when using a piezoelectric energy source. The device can be either a flash tube, where the voltage breaks down an inert gas, generating about a 700 volt pulse lasting typically 2 to 3 milliseconds, or a metal oxide varistor (MOV) which is a solid state equivalent of the gas tube. In either case, the resulting pulse must be stretched efficiently by a low-pass filter to reduce the peak voltage to between 5–12 volts when connected to a 1000 ohm load; the duration of the ersatz supply should be in the order of several hundred milliseconds including the inefficiency of the filter and the effects of the 1000 ohm load.

Figure 5A:
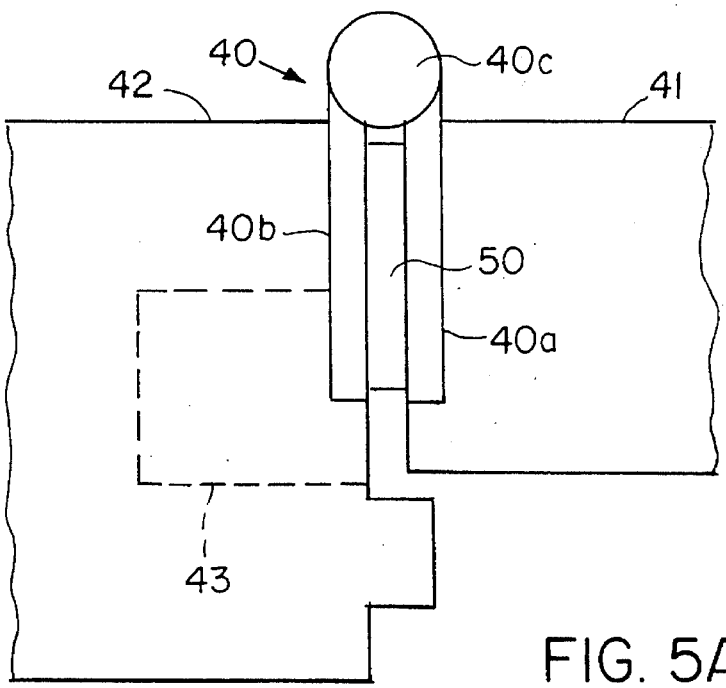
FIGS. 5*a* and 5*b* show the piezoelectric sensor mounted in position with the door closed and open, respectively.
Figure 5B:
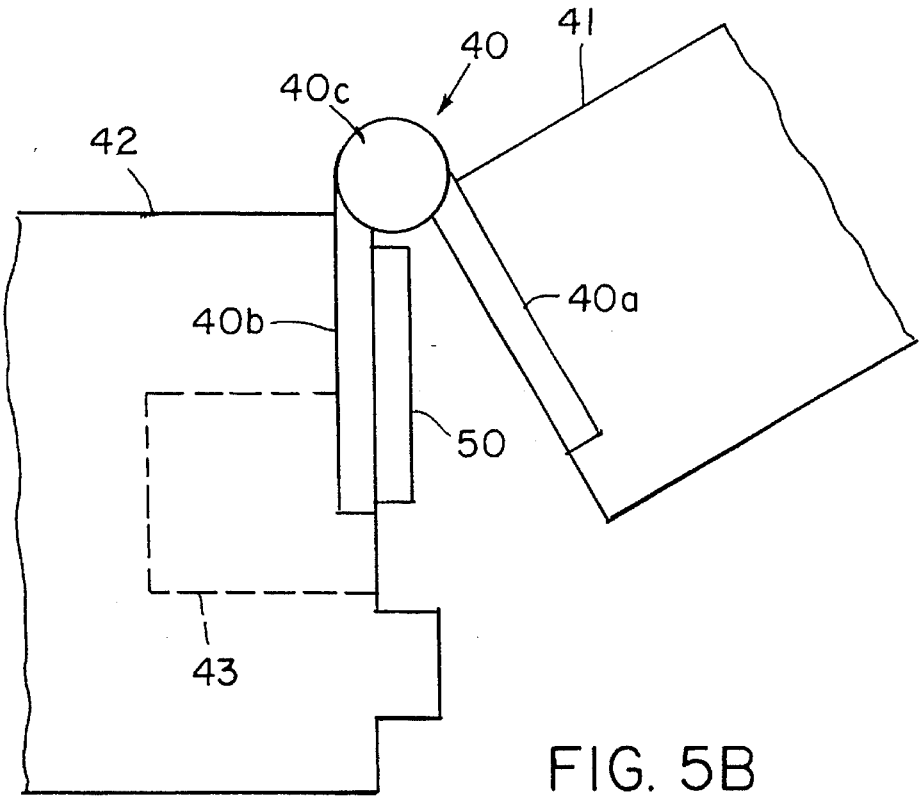

FIGS. 5*a* and 5*b* show a door 41 mounted on a door jamb 42 by means of a hinge 40 made up of a hinge pin 40*c*, an arm 40*a* connected to the door 41 and an arm 40*b* connected to the door jamb 42. The other hinge is not shown. An electronic assembly 43 is covertly mounted in the door jamb 42. FIG. 5*a* shows the closed door 41, and FIG. 5*b* shows the open door 41. A PZT crystal assembly 50 is mounted on hinge arm 40*b* by a suitable means.

Figure 5C:
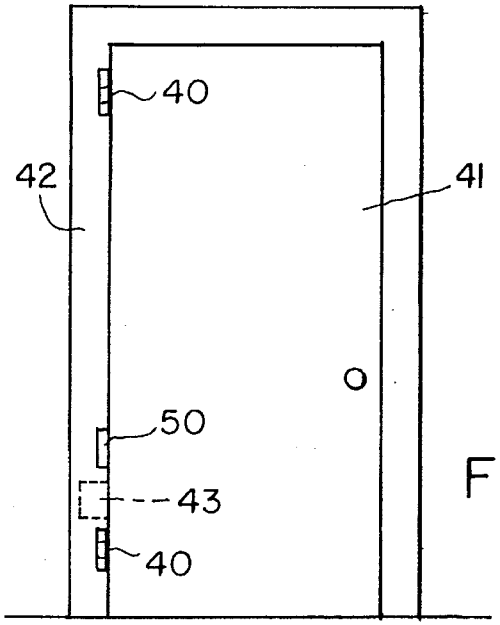
FIG. 5*c* shows an alternate position for the sensor.

FIG. 5*c* shows the PZT crystal assembly 50 and the electronics assembly 43 mounted in the door jamb 42 at the hinge 40 side of door 41.

Figure 6:
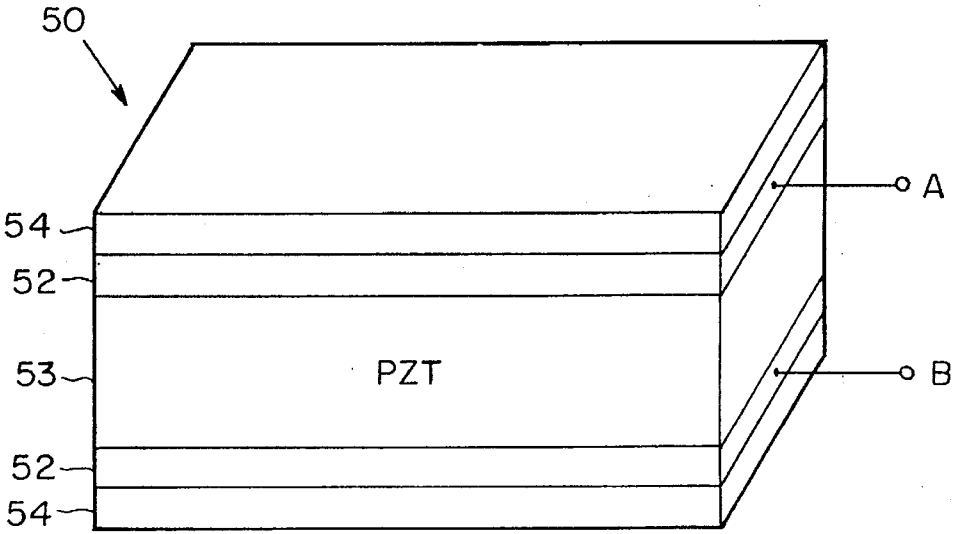
FIG. 6 shows the layers of the piezoelectric assembly.

FIG. 6 shows the details that make up the PZT crystal assembly 50. Consider the PZT crystal assembly 50 as a sandwich made up of phenolic bases 54, copper conductor layers 52 and a PZT crystal 53. Terminals A and B couple the copper conductors 52 to the electronics assembly 43.

If one attempts to connect a load (e.g., a 1,000 ohm oscillator load) directly to the output terminals of the ceramic block, then there is no energy output. This is because the charge on the piezoelectric crystal leaks off faster than it builds up. We found, experimentally, that the ideal way to extract energy from the ceramic piezoelectric material is to ensure that the output terminals drive a literal "open circuit" until a threshold voltage is reached, and at that point, let the charge that builds up, discharge and excite a low-pass filter and circuit load. One device we've used for this application is an inexpensive 700 volt type RS (gas) flash tube available at Radio Shack for $4.

Figure 7:
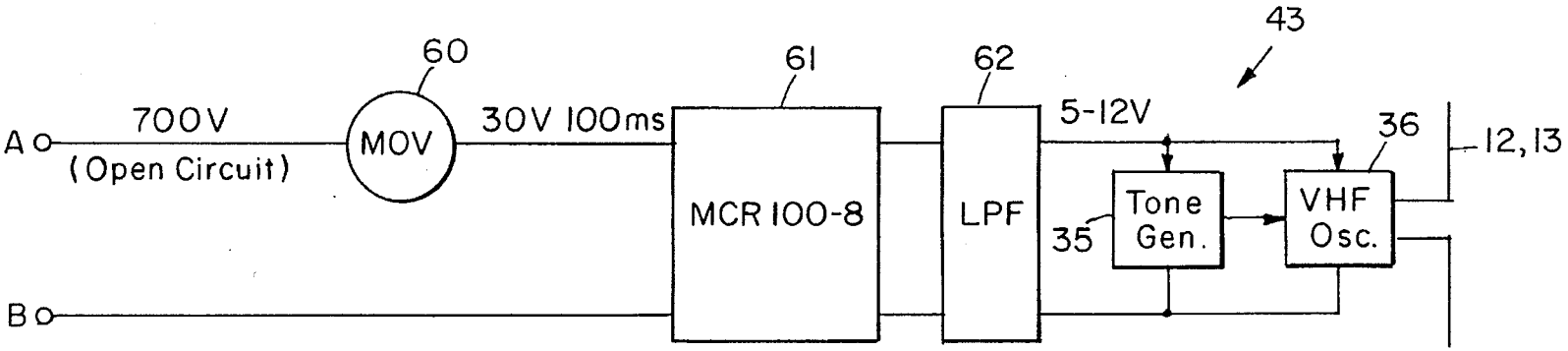
FIG. 7 shows an electronic circuit for transmitting coded signals from the piezoelectric assembly.

FIG. 7 shows the elements of the electronics assembly 43 which includes a MOV 60 generating a 30 volt signal for 100 milliseconds. This feeds the MCR100-8 SCR 61 and the LPF 62. The 5–12 volt output is applied to the tone generator 35 and the VHF oscillator 36 which feeds the frequency coded signal to the dipoles 12 or 13.

The coded RF output signals from the tone generator 35 and the VHF oscillator 36 for the rack and pinion sensor 1, the door knob sensor 20 and the piezoelectric sensor 50 are coded to identify the source of the signal. This is described fully in the referenced '303 patent.

Figure 8A:
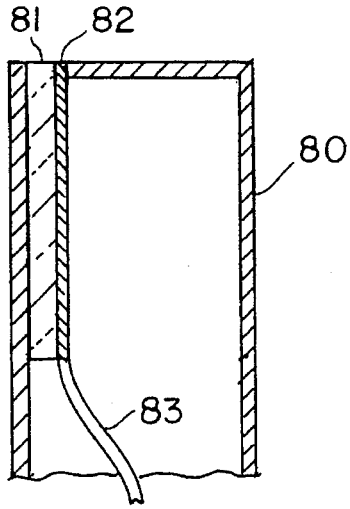
FIG. 8*a* shows a cross section of the patch antenna.
Figure 8B:
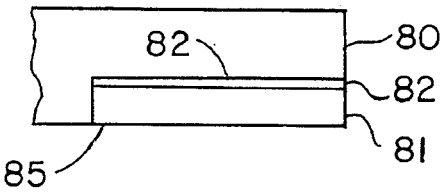
FIG. 8*b* shows a top view of the door with an opening for the patch antenna.

FIG. 8 shows the mounting of a totally flush patch antenna 13 for use with either the rack and pinion sensor 1 including its electronics 21, the door knob 20 including its electronics 21 or the piezoelectric source 50 and electronics 43, mounted in a metal door 80 having hinges 84. For convenience, the three sensors are all shown in FIG. 8. However it is understood that only one of the sensors are mounted on the door 80. The keylock knob sensor 20 is mounted in the door as shown in FIG. 3, the PZT crystal assembly 50 may be mounted on the door hinge 84 and the electronics 43 may be mounted in the metal door 80 in a similar fashion as shown in FIGS. 5*a*, 5*b* and 5*c*. A coaxial cable 83 is run covertly to a patch antenna 13 from the sensor electronics 21 or 43. The patch antenna 13 is mounted internal to the metal door 80. A metal patch 82 of patch antenna 13 is separated from the metal door 80 by a dielectric 81. FIG. 8*a* is a cross section view of the patch antenna 13. FIG. 8*b* shows an opening 85 in the top of metal door 80 to expose patch antenna 13. The theory of the patch antenna 13 is described in the "Handbook of Microstrip Antennas", edited by J. R. James and P. S. Hall and published by Peter Peregrinus Ltd., London, U.K. 1989.

It is therefore obvious to detect and record all protected openings in the area when the business opens. This enables one to verify that the protected openings are closed at the close of the business day.

While the invention has been shown and described with reference to the preferred embodiment thereof, it will be understood by those skilled in the art that the above and other changes in form or detail may be made therein without departing from the spirit and scope of the invention.

We claim:

1. A system of batteryless sensors for detecting door openings by an intruder, each of said batteryless sensors comprises:

a door knob having a first section and a second section for opening and closing said door;

generator means having a casing and permanent magnet pole pieces coupled to said casing, said generator means further having a gear train and an armature coupled to a shaft, said casing being press fit into an opening in said first section, said first section, said second section and said shaft having a common axis;

means for fastening said axial shaft to said door so that any rotation of said first and said second sections results in a relative rotation of said pole pieces with said armature thereby generating a voltage;

electronic means coupled to said generator means and responsive to said voltage for generating a coded RF signal identifying said sensor, said electronic means further having means for coupling said coded RF signal to said door knob for radiating said coded RF signal; and receiver means for receiving said coded RF signal radiated from said door knob for signaling that said intrusion occurred and identifying a site of said intrusion.

2. The system of claim 1 wherein said electronic means comprises:

means for filtering said voltage;

a full wave bridge rectifier for receiving said filtered voltage and producing a voltage signal;

a tone generator for receiving said voltage signal and producing a unique frequency signal to identify said sensor;

an oscillator for receiving said unique frequency signal and generating said coded RF signal;

said coupling means including a capacitor for coupling said coded RF signal to said door knob.

3. A system for detecting an opening or closing of a number of doors at one or more locations, each of said doors having a covert batteryless sensor, said system including a receiver for indicating the opening or closing of any one of the doors, each of the sensors comprising:

a piezoelectric energy source mounted on a hinge side of a door jamb so that said piezoelectric energy source is squeezed between plates of a hinge with a predetermined force when said door is closed and is released when said door is opened thereby generating a peak voltage signal into a predetermined load for a predetermined duration, both when said predetermined force is applied to said source, and when said predetermined force is released from said source:

electronic means for providing said predetermined load for generating a coded RF signal identifying said door that was disturbed;

said receiver responsive to said coded RF signal from any one of said sensors for signaling that said intrusion occurred and identifying a site of said intrusion.

4. The system of claim 3 wherein said predetermined force is 70 pounds.

5. The system of claim 3 wherein said predetermined load is 1000 ohms.

6. The system of claim 3 wherein said piezoelectric energy source comprises:

a piezoelectric crystal having a flat top surface and a flat bottom surface, said top and bottom surfaces being parallel to each other, a pair of flat copper conductors, a first flat copper conductor covering said flat top surface, and a second flat copper conductor covering said flat bottom surface; and a pair of flat phenolic sheets, a first flat phenolic sheet covering said first flat copper conductor and a second flat phenolic sheet covering said second flat copper conductor.

7. The system of claim 6 wherein said electronic means further comprises:

a silicon controlled rectifier coupled to said threshold device means and to a low pass filter for reducing said predetermined value to between 5 and 12 volts for said predetermined duration in the order of several hundred milliseconds.

8. The system of claim 6 wherein said electronic means comprises:

an open circuited/short circuited threshold device means for receiving said peak voltage signal and generating a voltage signal having a predetermined value for a predetermined time.

9. The system of claim 8 wherein said threshold device means is a metal oxide varistor having said predetermined value of 30 volts and said predetermined duration of 100 milliseconds.

10. The system of claim 8 wherein said threshold device means is a flash tube having said predetermined value of 700 volts and said predetermined time in the order of 2 to 3 milliseconds:

11. A system for detecting an opening or closing of a number of doors at one or more locations, said system including a receiver for indicating the opening or closing of any one of said doors, one or more of said doors being of all metal construction and each of said doors having a covert BATTERYLESS sensor, each of the sensors comprising:

sensing means for detecting an opening or closing of said door and generating an electronic signal;

electronic means for accepting said electronic signal and generating a coded RF signal over a coaxial cable;

a flush patch antenna including a radiating element, said metal door and a dielectric material mounted to an inside surface of said metal door insulating said radiating element from said metal door, said metal door including a top opening for exposing said radiating element;

said flush patch antenna accepting said coded RF signal over said coaxial cable for radiating said coded RF signal to said receiver.

* * * * *